United States Patent [19]

Calnek et al.

[11] Patent Number: 4,536,775

[45] Date of Patent: Aug. 20, 1985

[54] THERMAL PRINTING APPARATUS

[75] Inventors: Trevor A. Calnek, Waterloo; John E. Bray, Guelph, both of Canada

[73] Assignee: NCR Canada Ltd - NCR Canada Ltee, Mississauga, Canada

[21] Appl. No.: 561,489

[22] Filed: Dec. 14, 1983

[51] Int. Cl.[3] ..... H05B 5/08

[52] U.S. Cl. ..... 346/76 PH; 400/120; 219/216; 219/10.75

[58] Field of Search ..... 219/10.57, 10.75, 216 PH, 219/10.49 R, 10.49 A; 346/74.2, 74.6, 74.5, 76 R, 76 PH, 76 L; 250/316.1, 317.1, 318, 319; 101/8, 9, 21, 25, 27, 31; 400/120, 148, 152

[56] References Cited

U.S. PATENT DOCUMENTS

| | | | |
|---|---|---|---|
| 2,486,985 | 11/1949 | Ruderfer | 101/93 |
| 2,515,381 | 7/1950 | Resch | 400/120 |
| 3,139,026 | 6/1964 | Meckstroth et al. | 101/93 |
| 3,161,457 | 12/1964 | Schroeder et al. | 346/76 |
| 3,476,877 | 11/1969 | Perkins et al. | 178/23 |
| 3,509,980 | 5/1970 | Loughry et al. | 197/1 |
| 3,578,946 | 5/1971 | Colello | 219/216 |
| 3,631,512 | 12/1971 | Janning | 346/76 R |
| 3,726,212 | 4/1973 | Combs | 101/21 |
| 3,764,767 | 10/1973 | Randolph | 144/358 |
| 3,985,216 | 10/1976 | McIntosh et al. | 197/1 R |
| 4,462,035 | 7/1984 | Koto | 346/76 PH |

*Primary Examiner*—E. A. Goldberg
*Assistant Examiner*—A. Evans
*Attorney, Agent, or Firm*—Albert L. Sessler, Jr.

[57] ABSTRACT

Thermal printing apparatus includes a magnetic core having a gap, an electromagnetic coil mounted on the core for generating an electromagnetic field in the core and through the gap, a rotatably mounted cylindrical thermal print head having type characters on its periphery and located partially within the gap in the magnetic core, and a mechanism for rotating the print head to locate a selected type character in printing position in cooperative relation to a pressure element. The magnetic field generates circulating currents in the print head for heating it to a temperature necessary for causing heat-sensitive ink to be transferred from a ribbon to a record medium, both of which are positioned between the print head and the pressure element.

3 Claims, 4 Drawing Figures

THERMAL PRINTING APPARATUS

BACKGROUND OF THE INVENTION

This invention relates to an apparatus for printing. One problem with impact-type printers has been the noise which is generated by the operation of such printers. Thermal printers, on the other hand, are of the non-impact type, and are therefore generally much more quiet in operation. Thermal printers are usually of the dot matrix type, comprising a plurality of individual elements in the form of a matrix which can be energized in selected patterns to form the numbers, letters, symbols and other indicia needed. Each selected element must be heated and cooled from one character print to the next. Such printers consequently are subject to burn-out and failure, as well as to wear from contact with the ribbon or record medium which they engage, since they are normally not moved into and out of engagement with the record medium for each character printed. In addition, it is difficult to obtain a letter-quality print character with a dot matrix unless a very high density head comprising many individual elements is employed. Such a head is relatively expensive, and will probably need to be replaced fairly frequently, due to the possibility of wear and burn-out of one or more of the elements making up such a head. High quality of print is particularly important in printing MICR (magnetic ink character recognition) characters such as are commonly used on documents such as bank checks and which are capable of being read by machine. It will be seen that a thermal printer capable of printing a full-face, non-matrix character would overcome the problems described above, and would be particularly valuable in the case of printing MICR characters.

SUMMARY OF THE INVENTION

In accordance with one embodiment of the present invention, printing apparatus comprises a thermal print head and means operatively associated with said thermal print head and operable to cause a magnetic field to be passed through said thermal print head to cause said head to be heated inductively for thermal printing.

It is accordingly an object of the present invention to provide a printing apparatus including a thermal print head capable of being heated inductively.

A further object is to provide a printing apparatus which includes a rotatable thermal print head having type characters disposed along its periphery which is rotatable to cause a selected character to be disposed in printing position, and which is heated by circulating currents within the head which are generated by an electromagnetic field.

Another object is to provide a thermal printing apparatus of novel and efficient design.

With these and other objects, which will become apparent from the following description, in view, the invention includes certain novel features of construction and combinations of parts, one form or embodiment of which is hereinafter described with reference to the drawings which accompany and form a part of this specification.

DETAILED DESCRIPTION

Figure 1:
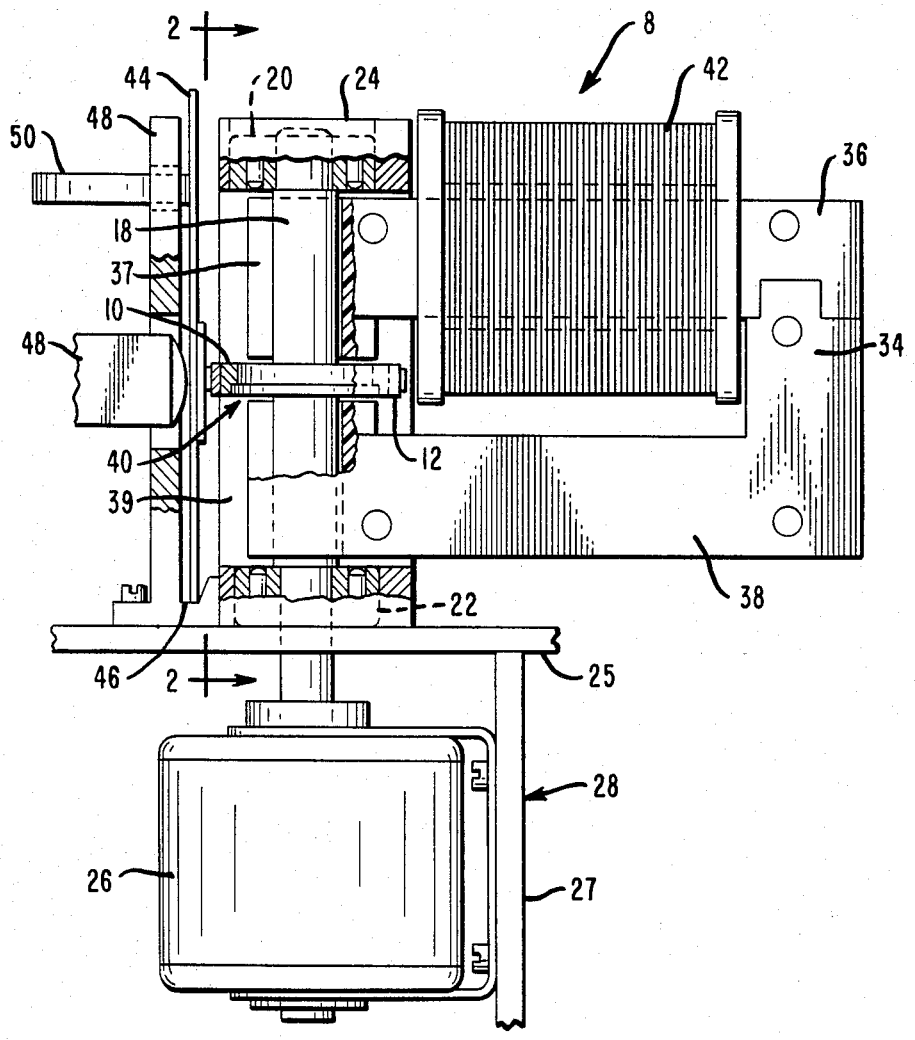
FIG. 1 is an elevation view, partially in section, of a printing apparatus constructed in accordance with the invention.
Figure 2:
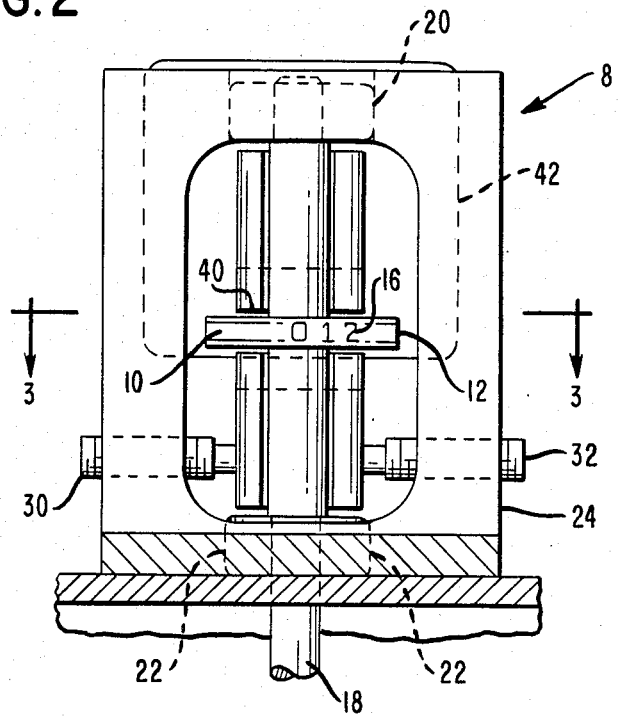
FIG. 2 is a sectional view taken along line 2—2 of FIG. 1.
Figure 3:
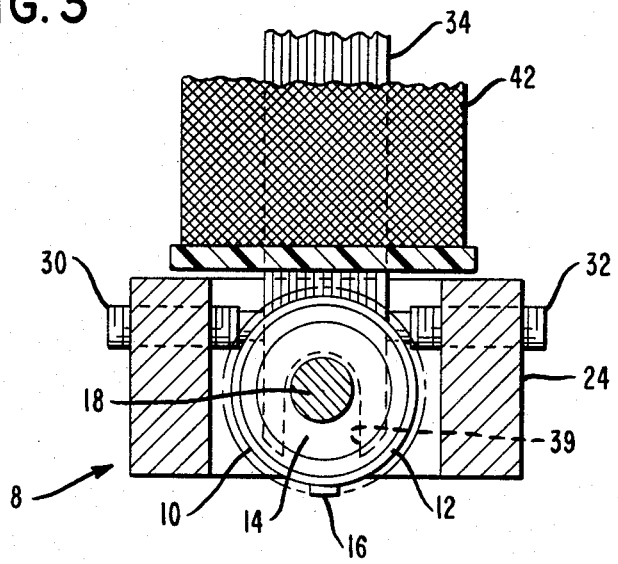
FIG. 3 is a sectional view taken along line 3—3 of FIG. 2.

Referring now to FIGS. 1–4, there is shown a thermal printing apparatus 8 which includes a thermal print head 10 which is of a disk-like configuration and includes an exterior annnular member 12 made from an electrically conductive low-resistance material such as copper, gold, silver or aluminum, and an internal hub member 14 made from a rigid non-conductive material, such as a polymer. Spaced around the periphery of the annular member 12 are a plurality of print characters 16, such as letters, numbers, symbols or other indicia.

The hub 14 of the print head 10 is fixed to a shaft 18 of non-magnetic material which is journaled for rotational movement in bearings 20, 22 which are fixed in a frame 24. A motor 26 is fixed to an extension 28 comprising elements 25 and 27 of the frame 24 and may be suitably coupled to the shaft 18 for rotating the print head 10 a predetermined amount to position a character 16 on the print head 10 for printing.

Also fixed to the frame 24 by suitable means such as a pair of set screws 30, 32 is a core 34 of suitable magnetic material, such as ferrite or laminated steel. The two legs 36 and 38 of the core 34, at their ends, define a gap 40. The core legs 36 and 38 are slotted at slots 37 and 39 respectively to accommodate the shaft 18 which extends therethrough. At all times a portion of the print head 10 is located within the gap 40. An electromagnetic coil 42 is positioned on the leg 36 of the core 34 and, when energized, produces an electromagnetic field in the core 34 and through the gap 40.

A record medium such as a document 44 to be printed upon by the thermal printing apparatus 8 may be transported along a track 46 which includes a wall 48 and a drive roller 50 to a position opposite the print head 10, at which point it is located between the head 10 and a pressure element 52. A ribbon 54 extends between the head 10 and the document 44, or alternatively the document 44 may be of a heat-sensitive composition, in which case no ribbon is required and printing is effected by operative contact between the document 44 and the print head 10.

Figure 4:
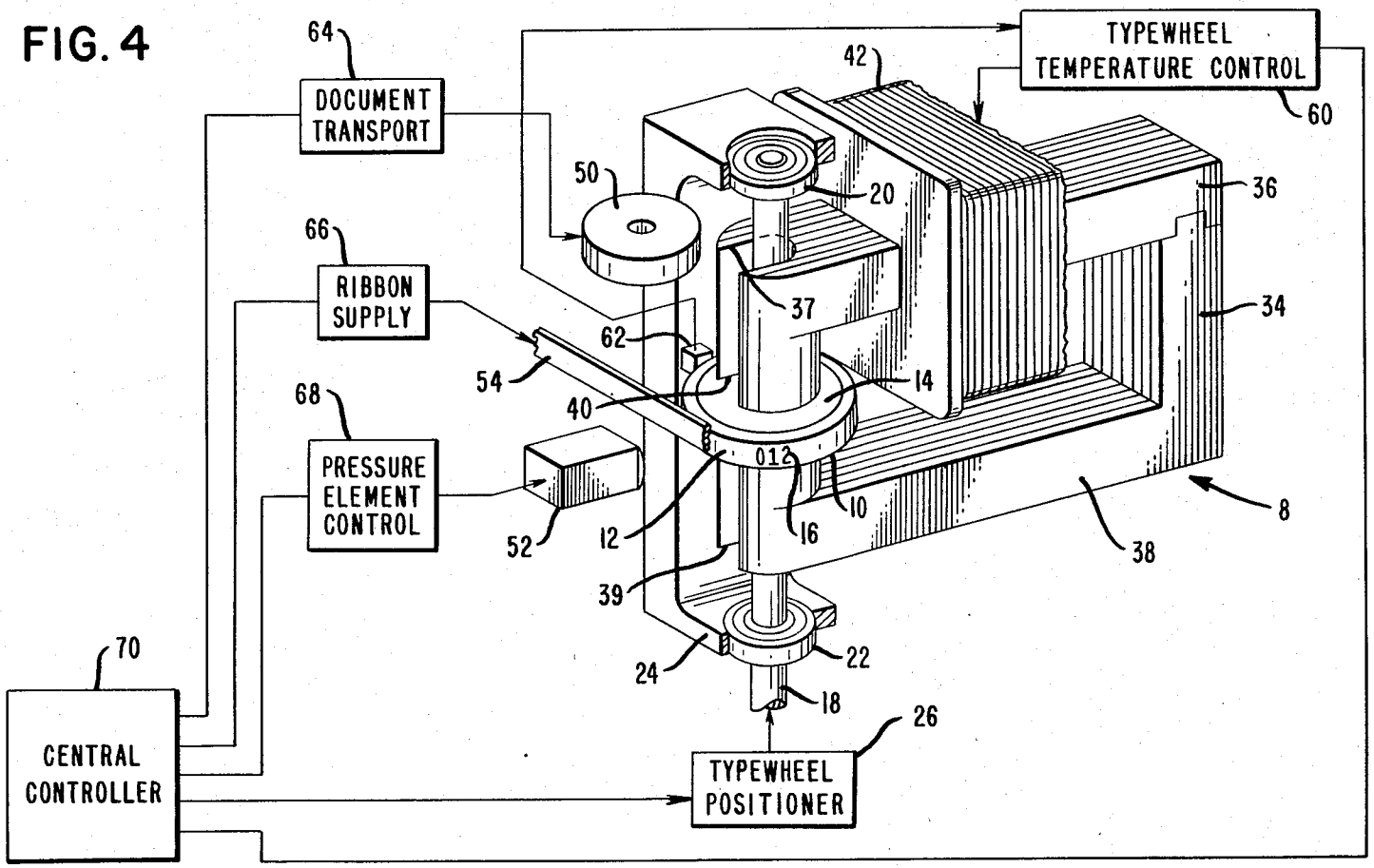
FIG. 4 is a perspective view of the printing apparatus and also shows diagrammatically the various control means for the printing apparatus.

Diagrammatically shown in FIG. 4 are the various control means which are utilized in the operation of the printing apparatus 8. A type wheel temperature control 60 applies suitable A.C. electrical power, which may be, for example, amplitude modulated 60 cycles, 110 volts, to the coil 42 sufficient to maintain the temperature of the print head 10 at a suitable level for printing. For most applications, 70 degrees C. is considered to be a suitable temperature.

A temperature sensing element 62 is positioned adjacent to the print head 10 and the data which it provides is transmitted back to the type wheel temperature control 60 to provide the necessary adjustments in the power applied to the coil 42. It will be understood that as the field generated by the application of A.C. power to the coil 42 expands and collapses, the lines of force generated thereby intersect the conductive annular element 12 of the print head 10 and generate high circulating currents in said element, thereby generating heat for printing.

Movement of the print head 10 to position a desired character in printing position is controlled by a type wheel positioner, which may, as previously described, be a motor 26.

In order for document printing to take place, the document 44 must be transported into printing position, which is accomplished by a document transport 64. The necessary feeding of the ribbon 54 is accomplished by a ribbon supply 66. The print head 10, ribbon 54 and document 44 are brought into the necessary engagement for printing by the pressure element 52, the movement of which is controlled by a pressure element control 68. Coordination of these various control elements to perform in the desired sequence and cooperation is accomplished by a central controller 70, which may, for example, comprise a suitably programmed microprocessor.

While the invention has been shown and described in terms of a preferred embodiment thereof, it will be understood that this invention is not limited to this particular embodiment and that many changes and modifications may be made without departing from the true spirit and scope of the invention as defined in the appended claims.

What is claimed is:

1. Printing apparatus comprising support means;

a magnetic core having a gap therein and having a slot in said core which extends through the gap, and mounted on said support means;

a coil mounted on said core and capable of generating a magnetic field in said core which extends through said gap;

a rotatable cylindrical thermal print head including an annular element of high conductivity material having a plurality of print characters arranged on the periphery thereof and fixed to a central hub of nonconductive material, said print head being located at least partially within the gap of said magnetic core;

shaft means disposed within the slot in said magnetic core for rotatably mounting said print head on said support means in operative relation to the gap of said magnetic core;

motor means mounted on said support means and operatively coupled to said shaft means for moving said print head to position a selected character for printing; and means to energize said coil to generate an electromagnetic field in said magnetic core, said electromagnetic field generating circulating currents in said annular element to heat said print head to a temperature suitable for thermal printing.

2. The printing apparatus of claim 1 also comprising record medium transport means for moving a record medium into position for printing by said print head;

thermal transfer ribbon supply means for providing thermally sensitive material which can be transferred to a record medium with the application of heat thereto; and pressure means capable of relative movement with respect to said thermal print head to cause a character representation to be applied to a record medium from said thermal transfer ribbon as a consequence of engagement of the thermal transfer ribbon means with said thermal print head and the record medium.

3. The printing apparatus of claim 2 also comprising central controller means coupled to and controlling said motor means, said means to energize said coil, said record medium transport means, said thermal transfer ribbon supply means and said pressure means, in order to provide coordinated operation of said printing apparatus.

* * * * *